United States Patent [19]

Percival

[11] Patent Number: 4,576,292

[45] Date of Patent: Mar. 18, 1986

[54] MODULAR DISPLAY UNIT FOR ARTICLES OF MERCHANDISE

[76] Inventor: George E. Percival, 10 Twain St., Bloomfield, N.J. 07003

[21] Appl. No.: 754,348

[22] Filed: Jul. 11, 1985

[51] Int. Cl.[4] ..... A47F 5/08

[52] U.S. Cl. ..... 211/49.1; 211/88; 248/220.4

[58] Field of Search ..... 211/88, 90, 49.1, 50, 211/55; 248/220.3, 220.4, 221.1, 221.2

[56] References Cited

U.S. PATENT DOCUMENTS

| | | | |
|---|---|---|---|
| 2,879,899 | 3/1959 | Shenkin | 248/220.4 X |
| 2,943,835 | 7/1960 | Tierney | 248/220.4 |
| 2,954,125 | 9/1960 | Husted | 248/220.4 X |
| 3,830,374 | 8/1974 | Kassimir | 248/220.3 X |
| 4,155,459 | 5/1979 | Marschak | 248/220.4 X |

FOREIGN PATENT DOCUMENTS

| | | | |
|---|---|---|---|
| 824358 | 10/1969 | Canada | 248/220.3 |
| 357963 | 12/1961 | Switzerland | 211/187 |

*Primary Examiner*—Robert W. Gibson, Jr.
*Attorney, Agent, or Firm*—Gottlieb, Rackman & Reisman

[57] ABSTRACT

A modular display unit for articles of merchandise includes a plurality of paired article-supporting fixture members mounted by means of prongs on an upright apertured carrier board secured to a support structure by means of a pair of horizontally spaced vertical posts each of which projects frontwardly of the front surface of the carrier board. In a basic module, each of the paired fixture members has a bottom wall, a front end wall, a rear end wall, and a left-hand or right-hand side wall, so that the two fixture members define an open-topped compartment with a split article-supporting surface constituted by the two bottom walls. To accommodate the posts, a step region of sufficient depth is provided on each fixture member at the juncture between its side wall and its rear end wall. A tier of plural horizontally aligned compartments utilizing only two such fixture members at the ends of the tier can be formed by interposing between the right-hand and left-hand end fixture members at least one additional fixture member devoid of a side wall but having between its front and rear end walls a medial dividing wall extending over the bottom wall. Each such additional fixture member has a post-accommodating step region formed in its rear end wall where the same adjoins the dividing wall. The foregoing abstract is not to be deemed a complete exposition of the present invention, however, the details of which can be discerned only by reference to and from the hereto appended specification and claims.

8 Claims, 11 Drawing Figures

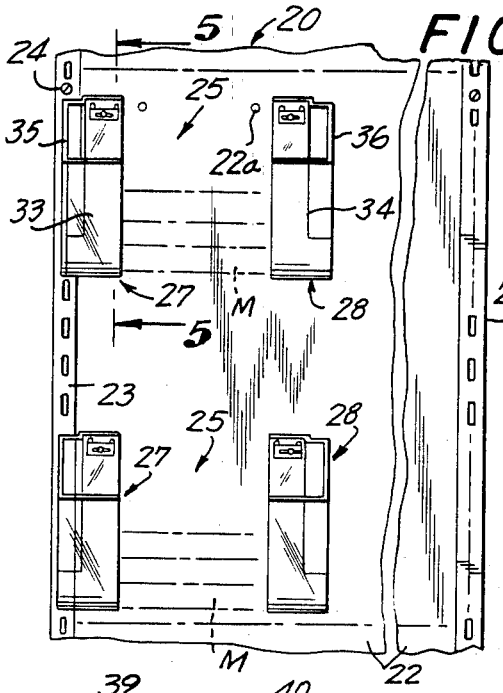
FIG.1
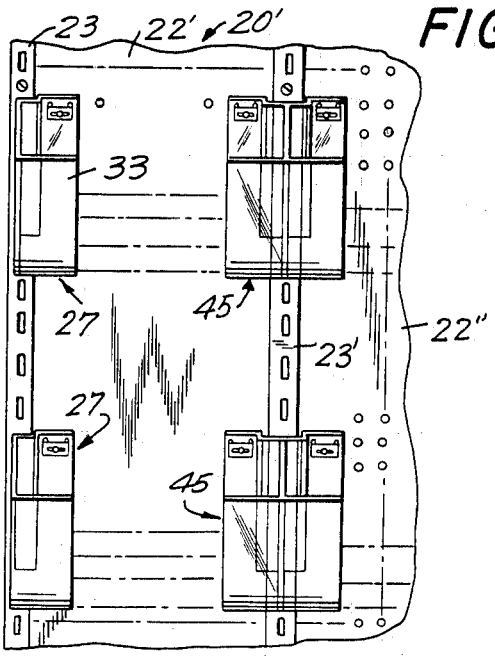
FIG.3
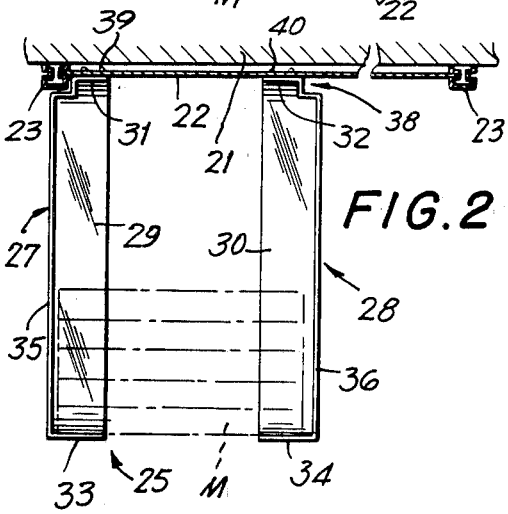
FIG.2
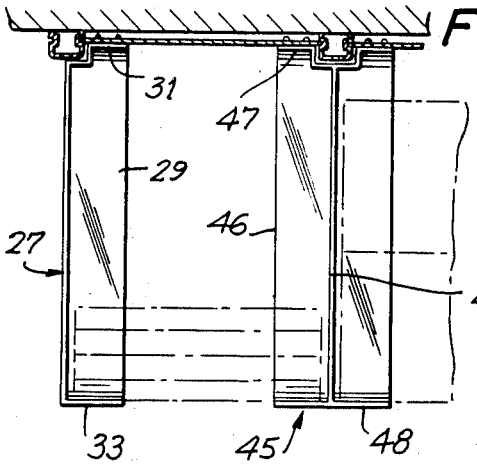
FIG.4
FIG.6
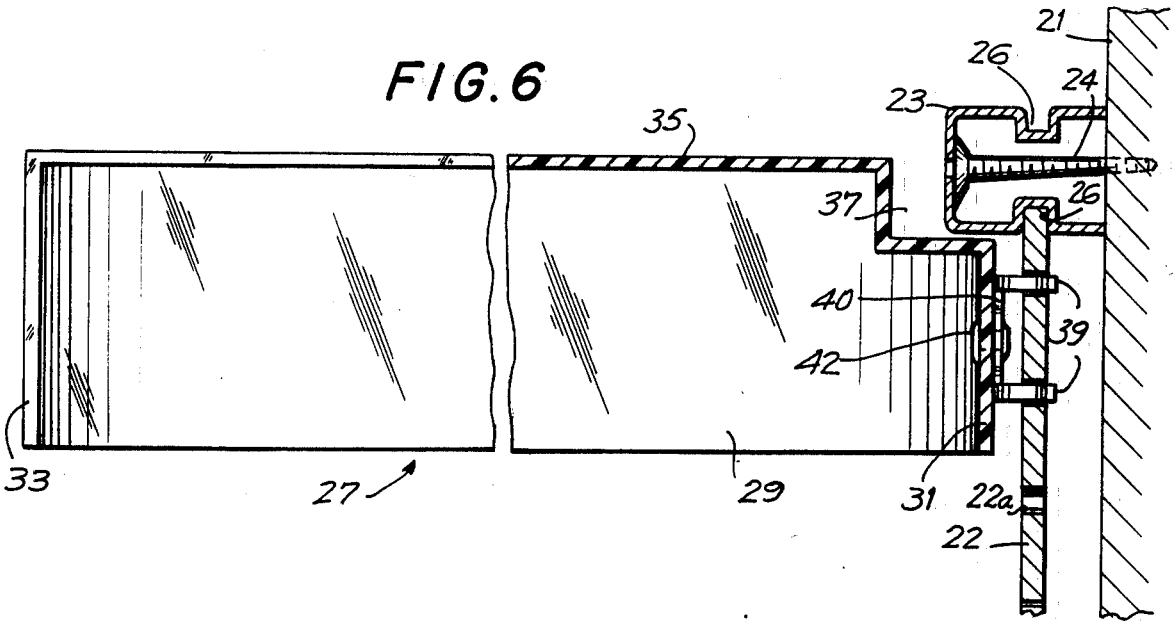

MODULAR DISPLAY UNIT FOR ARTICLES OF MERCHANDISE

This invention relates to a modular display unit for supporting and displaying articles of merchandise, with the individual article-supporting compartments being formed by combinations of paired modular fixture members supported by a vertical apertured carrier board (sometimes colloquially referred to as a "peg board"). Devices of this type are well known; see, for example, U.S. Pat. No. 2,879,899 (Shenkin) U.S. Pat. No. 2,913,210 (Tichnor), U.S. Pat. No. 4,064,991 (Swanson), and U.S. Pat. No. 4,155,459 (Marschak). In all of the known devices represented by the aforesaid patents, the various fixture members cooperate in pairs to define an open-topped compartment provided with a split article-supporting surface at its bottom and with each fixture member being selectively mountable on the apertured carrier board so as to enable the transverse dimension of the compartment to be correspondingly enlarged or decreased.

It has heretofore been customary, in the utilization of such devices, to secure the apertured carrier board to a wall at a spacing therefrom by nailing or bolting it directly and permanently to a pair of wooden support members (e.g. 2×4's) interposed between the rear surface of the board and the wall. While this can provide a very secure mounting of the carrier board, it entails the disadvantage that the nails, screws or like fasteners by which the carrier board is secured to the wooden support or spacer members are themselves driven through the board. Since carrier boards of the type here involved are generally made of particle board or the like, the fastening operation entails a structural weakening of the board. Moreover, the entire installation is somewhat cumbersome, because the wood support members must always be themselves first nailed to the wall before the carrier board can be fastened to the support members. Still further, the lateral spacing between the wooden support members has to be accurately predetermined for a given size of carrier board, so that once installed they cannot be used, for all practical purposes, with a carrier board of a different size. Moreover, if the spacing is somewhat inaccurate relative to a given size of board, the possibility exists that the fasteners may have to be driven through a portion of the board either too close to an edge thereof or too close to one of the interior apertures.

It is the principal objective of the present invention, therefore, to provide a modular display unit of the class described above by means of which the aforesaid drawbacks and disadvantages are effectively overcome.

To this end, it is proposed in accordance with one aspect of the present invention to secure a carrier board to its support structure, for example a wall, with the aid of a pair of bilaterally grooved or notched vertical stringers or posts, with each such post having the notch along one of its sides fitted over the proximate side edge of the carrier board and then fastened by means of screws or bolts to the wall. In this way the need for driving the fasteners directly through the carrier board is eliminated as is the possiblity of misalignment between the support members and the edges of the board. This type of mounting arrangement furthermore lends itself readily to the utilization of two or more boards in tandem and is independent of the sizes of the boards because the posts or support members are fitted to the sizes of the boards and not the other way around.

By virtue of their construction, of course, the notched support members perforce have portions thereof projecting beyond the front surface of the carrier board. This leads to the situation, however, that the standard article-supporting fixture members cannot be positioned close to the edges of the board where the same is fitted to the support members, whereby some degree of versatility of the board is lost in that a restraint is placed on the positioning of the artficle-supporting members in the regions of the edges of the board.

The objectives of the present invention are further achieved by providing each of the article-supporting fixture members for a modular display unit with a step region dimensioned and shaped to accommodate the portions of the support members or posts projecting beyond the front surface of the carrier board. To this end, it is contemplated by the present invention that the basic modular unit will consist of a "right-hand" and a "left-hand" fixture member paired with each other and each having a bottom wall, a rear end wall provided with the prongs by means of which the member will be mounted on the carrier board, a front end wall, and a side wall, with the side wall extending along one side of the bottom wall from the rear end wall to the front end wall, and with the rear end wall being stepped frontwardly at its juncture with the side wall to provide a step region adapted to accommodate the projecting portion of one of the vertical posts supporting the carrier board. In the left-hand fixture member, of course, the side wall is located on the left side of the bottom wall as the same is viewed from the front end wall toward the rear end wall, and correspondingly in the right-hand fixture member the side wall is disposed on the right side of the bottom wall as viewed from the front end wall toward the rear end wall. With the two side walls thus located on the remote sides of the two bottom walls, the paired fixture members define therebetween an open-topped compartment having a split article-supporting surface at its bottom, lateral boundaries defined by the two side walls, and a split front end boundary defined by the two front end walls.

The provision of a step region in the rear end wall of an article-supporting fixture member as described above for the left-hand and right-hand members can also be applied to an intermediate dual fixture member which has a bottom wall, a front end wall, and a rear end wall, and in lieu of a side wall a medial dividing wall extending from the front end to the rear end wall over the bottom wall. Such a dual fixture member would be used when it is desired to establish a tier of plural horizontally aligned compartments utilizing only two end fixture members. In such an arrangement, the half of the intermediate fixture member facing the left-hand end fixture member, for example, defines with the latter a compartment the lateral boundaries of which are constituted by the side wall of the left-hand fixture member and the dividing wall of the intermediate fixture member, while the other half of the intermediate fixture member cooperates with the next adjacent fixture member to the right (either another dual intermediate member or a right-hand end member) to define another article-supporting compartment. Each such intermediate fixture member is, in accordance with the present invention, provided with a step region in the rear end wall thereof where the same meets the dividing wall, so that the intermediate fixture member will be able to accommodate and straddle a vertical post, if need be, so as to be able to extend from one edge region of one carrier board to the proximate edge region of another carrier board.

In accordance with a refinement of the present invention, it is further contemplated that the prongs for mounting the individual fixture members on the carrier board will preferably be both angularly and laterally displaceable relative to their associated rear end walls. Such an arrangement enables the location of the prongs to be adapted to the fixed locations of the apertures in the carrier board, which is advantageous whenever at an edge region of the board the side portion of the support post projects too far over the front surface of the board and hence into too close proximity to the first vertical row of apertures.

In accordance with another refinement of the invention, each right-hand and left-hand fixture member will normally further be provided with a pair of pin-shaped protuberances in the lower region of its rear end wall, such protuberances being spaced and dimensioned to enable them to enter corresponding ones of the apertures in the carrier board for the purpose of enhancing the stability of the display unit as a whole by inhibiting any possibility of angular or rocking movement of the end fixture members. It will be understood that although such additional protuberances may also be provided on a dual or intermediate fixture member, they are not required because such a member has two sets of mounting prongs, one pair in the upper region of each of the sections of the rear end wall located on opposite sides of the step region, so that the engagement of these prongs in respective pairs of apertures in the board inherently provides the anti-rocking or stabilizing function.

In accordance with yet another refinement of the invention, the front end, rear end, side, dividing and bottom walls of the fixture members are all planar, and the bottom wall of each fixture member is oriented at an obtuse angle relative to the associated rear end wall. Here the angular arrangement is such that when the fixture is mounted with its rear end wall parallel to the carrier board and hence vertical, the bottom wall and thus the article-supporting surface is oriented at a slight downward slant toward the front end wall.

In this same type of construction, of course, a rearwardly extending projection or abutment may be provided in the lower region of the rear end wall of each fixture member, with the arrangement being such as to ensure that when the fixture member is mounted on the carrier board, the rear end wall of that fixture member is sufficiently angularly oriented relative to the carrier board as to dispose the bottom wall and hence the article-supporting surface in a horizontal plane.

The foregoing and other objects, characteristics and advantages of the present invention will be more clearly understood from the following detailed description thereof when read in conjunction with the accompanying drawings, in which:

FIG. 1 is a fragmentary front elevational view of a modular display unit according to the present invention and shows two article-supporting compartments defined by respective paired left-hand and right-hand fixture members;

FIG. 2 is a top plan view of the structure shown in FIG. 1;

FIG. 3 is a fragmentary front elevational view similar to FIG. 1 of a modular display unit including two article-supporting compartments each defined by a left-hand fixture member and a dual or intermediate fixture member to the right thereof;

FIG. 4 is a top plan view of the structure shown in FIG. 3;

FIG. 6 is a fragmentary sectional view taken along the line in 6—6 in FIG. 5;

Figure 5:
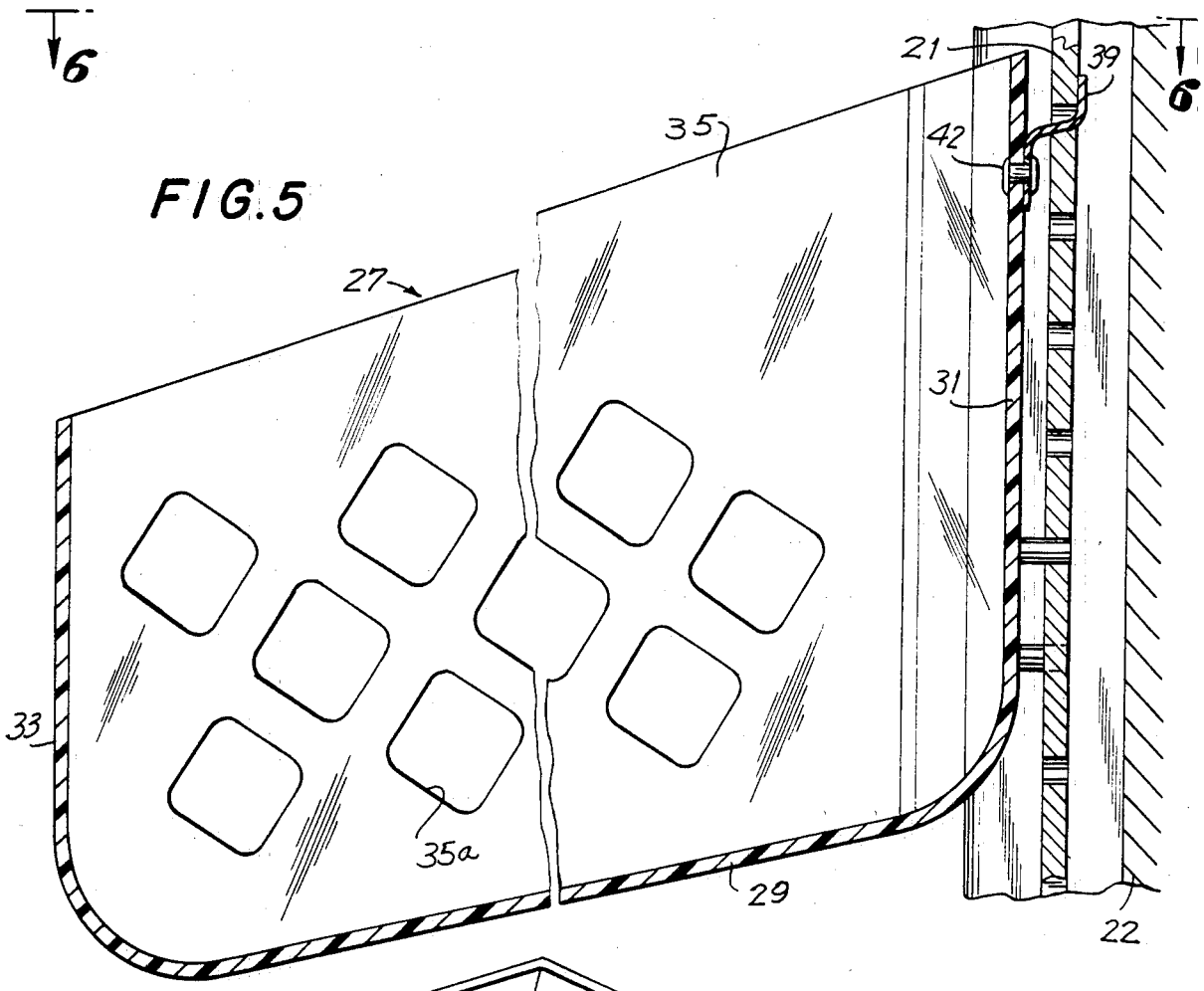
FIG. 5 is a fragmentary sectional view taken along the line 5—5 in FIG. 1.

Referring now to the drawings in greater detail, a display unit 20 (FIGS. 1 and 2) according to the present invention, which is adapted to be secured to an upright support structure 21, e.g. a wall, includes in its most basic form a conventional carrier board (peg board) 22 having throughout its expanse a plurality of rows and tiers of apertures 22*a*, a pair posts or support members 23 adapted to be fastened in vertical orientation to the support structure 21 by means of bolts or screws 24, and a plurality of modular article-supporting fixtures 25 mounted on the carrier board. When installed, the carrier board 22 is secured to the wall or other support structure 21, without being directly fastened thereto, through the intermediary of the posts 23, for which purpose (FIGS. 2 and 6) each post is provided on its opposite sides with a respective longitudinal groove or notch 26, with the opposite side edge regions of the carrier board being fitted into the proximate ones of the grooves 26 on the two posts 23.

Figure 7:
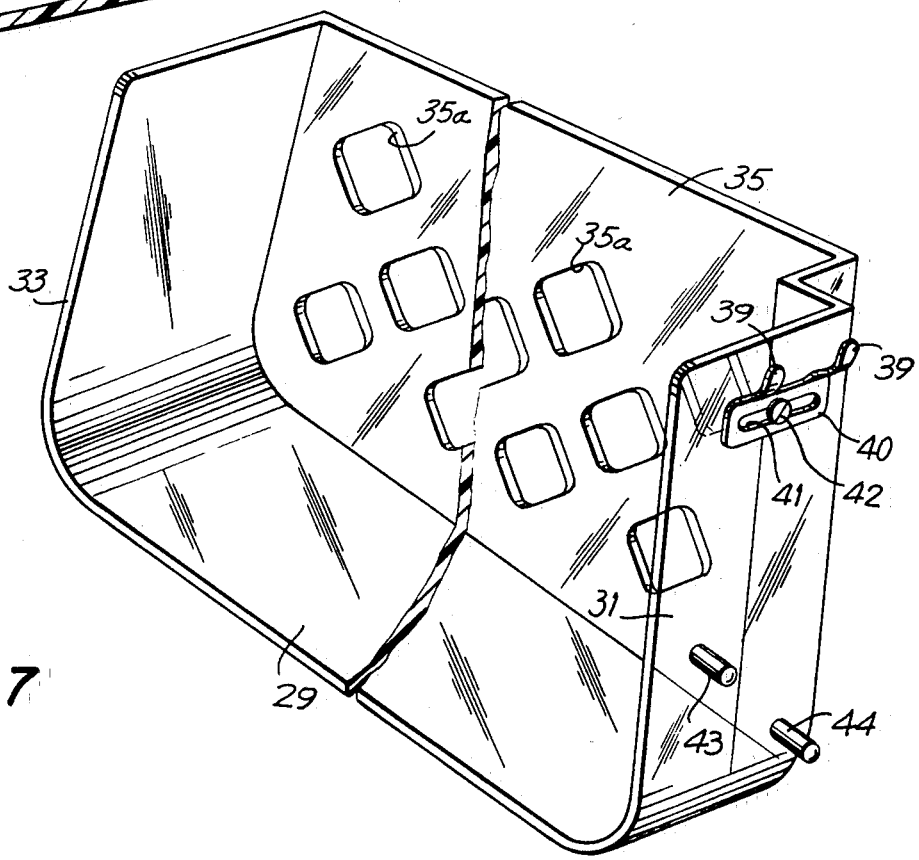
FIG. 7 is a fragmentary perspective illustration of the left-hand fixture member shown in FIGS. 1-6.

The basic modular article-supporting fixture 25 according to the present invention includes a pair of fixture members 27 and 28 having, respectively, bottom walls 29 and 30, rear end walls 31 and 32, front end walls 33 and 34, and side walls 35 and 36, each such side wall being located at one side of the associated bottom wall and extending between the associated front end and rear end walls. Thus, as best seen in FIG. 2, the fixture member 27 has the side wall 35 located at the left-hand side of the bottom wall 29, while the fixture member 28 has the side wall 36 located at the right-hand side of the bottom wall 30, in each case as viewed in the direction from the front end wall to the rear end wall. The two fixture members will, therefore, hereinafter be referred to as "left-hand" and "right-hand" fixture members, respectively. The fixture members are preferably made of a suitable transparent, sturdy and lightweight synthetic plastic material, e.g. general purpose styrene. Moreover, the side wall of each fixture member is preferably formed with a plurality of holes herein (although these are shown in FIGS. 5 and 7, where they are designated 35*a*, for the left-hand fixture member 35 only). Such holes can have any desired configuration other than that shown and can be arranged in any suitable pattern so as to have a decorative or esthetic effect, but their primary purpose is to effect a weight reduction of the fixture members.

As further shown in FIGS. 2, 6 and 7, the rear end walls 31 and 32 of the fixture members 27 and 28 are somewhat narrower than the respective front end walls 33 and 34, and they are stepped frontwardly at their junctures with the side walls 35 and 36 to define respective step regions 37 and 38. In each case, the depth of the step region 37 or 38 frontwardly of its associated rear end wall 31 or 32 is sufficient to accommodate the portion of the post 23 that projects beyond the front face of the carrier board 22. It will also be noted that in each fixture member (although again shown only for the fixture member 27) the bottom wall thereof is oriented at an obtuse angle to the associated rear end wall and at an acute angle to the associated front end wall, these angles being such that the two end walls are parallel to each other and that when the rear end wall is oriented vertically the bottom wall is oriented at a slight downward slant toward the front end wall. In essence, therefore, the two fixture members 27 and 28 are identical with each other except for being in mirror image relation to one another.

For the purpose of mounting the fixture members 27 and 28 on the carrier board 22, the fixture members are further provided in the upper regions of their rear end walls 31 and 32 with respective pairs of prongs 39 and 40 (FIG. 2). As shown in FIGS. 5, 6 and 7, the prongs 39 (and identically therewith the prongs 40 also) project rearwardly and upwardly relative to the associated rear end wall 31 in a somewhat hook-shaped form from a bar or bracket 40 having an elongated slot 41 therein. The bar 40 is displaceably secured to the rear end wall 31 by means of a rivet or bolt 42 the shank of which extends through the slot 41 and the rear end wall 31. The prongs thus have a degree of freedom of movement both laterally as well as angularly relative to their associated rear end walls. While this is not essential, it does have the advantage that is enables the location of the prongs to be adapted to the fixed locations of the apertures 22*a* in the carrier board, so that either fixture member can be properly mounted closely adjacent a post 23 even when the side portion of the latter projects too far over the front surface of the board and hence into too close proximity to the first vertical row of apertures.

As will be apparent from FIGS. 1 and 2, each two paired fixture members 27 and 28, when mounted on the carrier board as shown with their respective bottom walls 29 and 30 in transverse alignment with each other, defines an upwardly open compartment having a split article-supporting surface 29/30 at its bottom, lateral boundaries 35 and 36, and a split front end boundary 33/34. Each such compartment, therefore, the width of which is determined by the spacing between the associated fixture members 27 and 28, is adapted to receive one or more articles of merchandise M, the shapes and dimensions of which are such that they can extend between and rest upon the paired bottom walls 29 and 30. Such articles will, of course, have to be sufficiently self-supporting to retain their shape in the unsupported region between the bottom walls.

It will further be apparent from FIGS. 1 and 2 that a display unit according to the present invention, in addition to having a plurality of article-supporting fixtures 25 mounted in a vertical row one below the other, may also have a plurality of such fixtures, each again composed of a left-hand fixture member 27 and a right-hand fixture member 28 mounted on the board in one or more horizontal tiers. Should the right-hand fixture member of any such additional fixture be mounted on the board 22 in close proximity to the post 23 at the right-hand edge thereof, then its relation with that post would be the same as is illustrated in FIGS. 5 and 6 with respect the the left-hand fixture member 27 and its post 23. It will furthermore be understood that although the step regions 37 and 38 are provided to accommodate a post 23, they constitute no impediment to the mounting of either fixture member away from a post 23.

It will also be apparent to those skilled in the art that in any such fixture the magnitude of the load supported by either of the fixture members may at times be such as to cause a torque to be exerted on that fixture member which could result in the fixture member being displaced angularly and hence in the prongs thereof being pulled out of the respective holes or apertures 22*a* in the carrier board. In order to counteract this possibility, in accordance with a refinement of the present invention the fixture members 27 and 28 are further provided in the lower regions of their respective rear end wall 31 and 32 with pairs of pin-shaped protuberances 43 and 44 (only those of the left-hand fixture member are shown in FIGS. 5 and 7) which are shaped and dimensioned to be able to enter corresponding ones of the apertures 22*a* in the carrier board. In the illustrated embodiment of the invention, the protuberances or pins 43 and 44 are located at different levels above that of the bottom wall of the associated fixture member, with the pin closest to the respective side wall or step region being at a lower level than the pin closest to the open side. This arrangement of the pins could be varied, however, including their being located at the same level or with their illustrated levels reversed.

Figure 8:
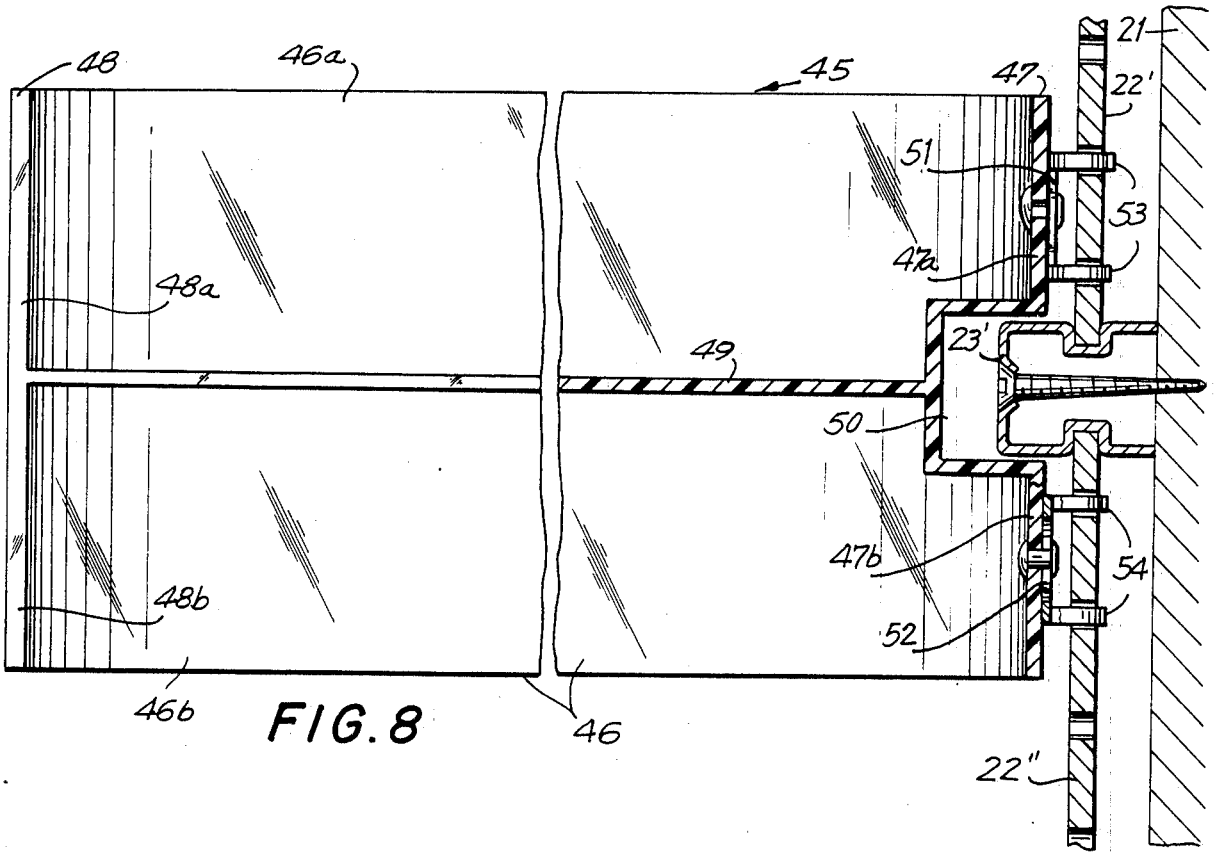
FIG. 8 is a sectional view, similar to FIG. 6, of the dual or intermediate fixture member shown in FIGS. 3 and 4.

It will be understood from the foregoing that where each article displaying compartment is to be defined by a respective pair of left-hand and right-hand fixture members 27 and 28, it will be necessary for the merchant to have on hand a supply of such fixture members adequate to enable him to set up the desired number of compartments. In accordance with a further refinement of the present invention, however, the number of such fixture members which must be maintained, for the purpose of providing a horizontal tier of adjacent compartments in which the fixture members 27 and 28 are utilized only at the opposite ends of the tier, can be materially reduced by the use of at least one intermediate dual fixture member 45 (FIGS. 3, 4 and 8) to create an extended display unit 20'. Each such intermediate fixture member has a bottom wall 46 twice as wide as the bottom wall 29 of the fixture member 27, a rear end wall 47 twice as wide as the rear end wall 31 or 32, a front end wall 48 twice as wide as the front end wall 33 or 34, and in lieu of a side wall a medial dividing wall 49 above the bottom wall and extending from the rear end wall 47 to the front end wall 48. Like the side walls 35 and 36 of the fixture members 27 and 28, the dividing wall of the fixture member 45 may be provided with holes (not shown in FIGS. 3, 4 and 8) of any desired shape and distribution pattern similar to those of the holes 35*a*. The rear end wall 47 at its juncture with the dividing wall 49 is provided with a step region 50 the depth of which frontwardly of the rear end wall 47 and the width of which to either side of the dividing wall 49 are sufficient to accommodate the portion of a post projecting beyond the front surface of a carrier board.

The angular relationships between the rear end wall 47, the bottom wall 46 and the front end wall 48 are the same as in the fixture members 27 and 28. Finally, in a manner corresponding to the prong arrangement on the fixture members 27 and 28, the intermediate fixture member 45 is provided, in the upper region of the two sections 47*a* and 47*b* of the rear end wall 47 located to either side of the step region 50, with respective rivet- or bolt-mounted laterally and angularly displaceable slotted bars 51 and 52 from which extend rearwardly and upwardly respective pairs of hook-shaped prongs 53 and 54 for mounting the fixture member 45 on a carrier board.

In this regard it will be noted that in the display unit 20', the intermediate fixture member 45 is mounted on two adjacent carrier boards 22' and 22'' and hence is disposed in straddling relation to a post 23' which engages the proximate side edge regions of the two carrier boards. The post 23' in this arrangement is, or course, a part of a three-post means for securing the carrier boards 22' and 22'' to the support structure 21, the two posts which engage the distal or remote side edge regions of the carrier boards being the post 23 shown at the left side of FIGS. 3 and 4 and another like post (not shown) located to the right of FIGS. 3 and 4. It will be understood, however, that whereas the presence of the step region 50 on the intermediate fixture member 45 is essential to enable a post such as 23' to be bridged, the intermediate fixture member could just as well be mounted on an inner region of a single carrier board, in a manner analogous to the mounting of the fixture members 28 shown in FIGS. 1 and 2, where no post is located.

It should also be noted that the dual intermediate fixture member 45 may be provided in the lower regions of its rear end wall sections 47*a* and 47*b* with pin-shaped protuberances such as the pins 43 and 44 of the fixture members 27 and 28. However, this is not essential and they will ordinarily be omitted because, with the intermediate fixture member being mounted on a carrier board (or two such boards) by means of two sets of prongs, it will already have the requisite degree of stability due to the fact that the dual prong arrangement inherently counteracts any possibility of angular displacement or rocking of the intermediate fixture member.

In the display unit 20', therefore, the half of the intermediate fixture member 45 facing the left-hand end fixture member 27 defines with the latter a compartment having lateral boundaries constituted by the side wall 35 of the left-hand fixture member and the dividing wall 49 of the intermediate fixture member, a split article-supporting surface constituted by the bottom wall 29 of the fixture member 27 and the left-hand section 46*a* of the bottom wall 46 of the intermediate fixture member, a front end boundary constituted by the front end wall 33 of the left-hand fixture member and the section 48*a* of the front end wall 48 of the intermediate fixture member, and a rear end boundary constituted by the rear end wall 31 of the left-hand fixture member and the section 47*a* of the rear end wall 47 of the intermediate fixture member. Correspondingly, the other half of the intermediate fixture member 45 to the right of the dividing wall 49, including the section 46*b* of the bottom wall, the section 47*b* of the rear end wall, the section 48*b* of the front end wall, and the said dividing wall, cooperates with the next adjacent fixture member to the right, which may be either another dual intermediate fixture member or a right-hand end fixture member, to define another article-supporting compartment.

Figure 9:
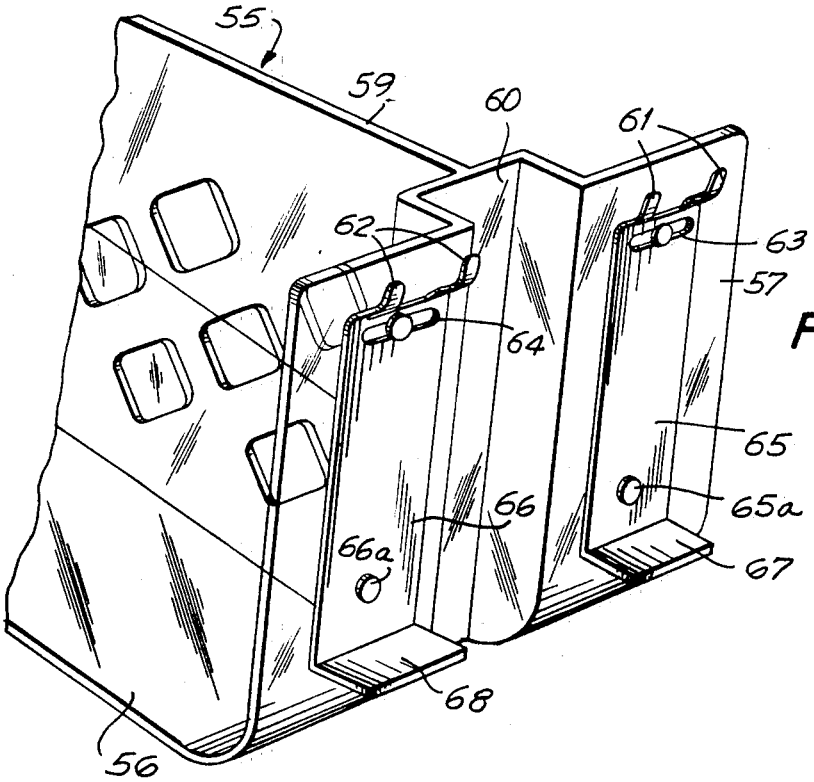
FIG. 9 is a fragmentary perspective illustration of a dual or intermediate fixture member provided with rearward projections or abutments to assure a horizontal disposition of the bottom wall of the fixture member when the latter is mounted on a carrier board.
Figure 10:
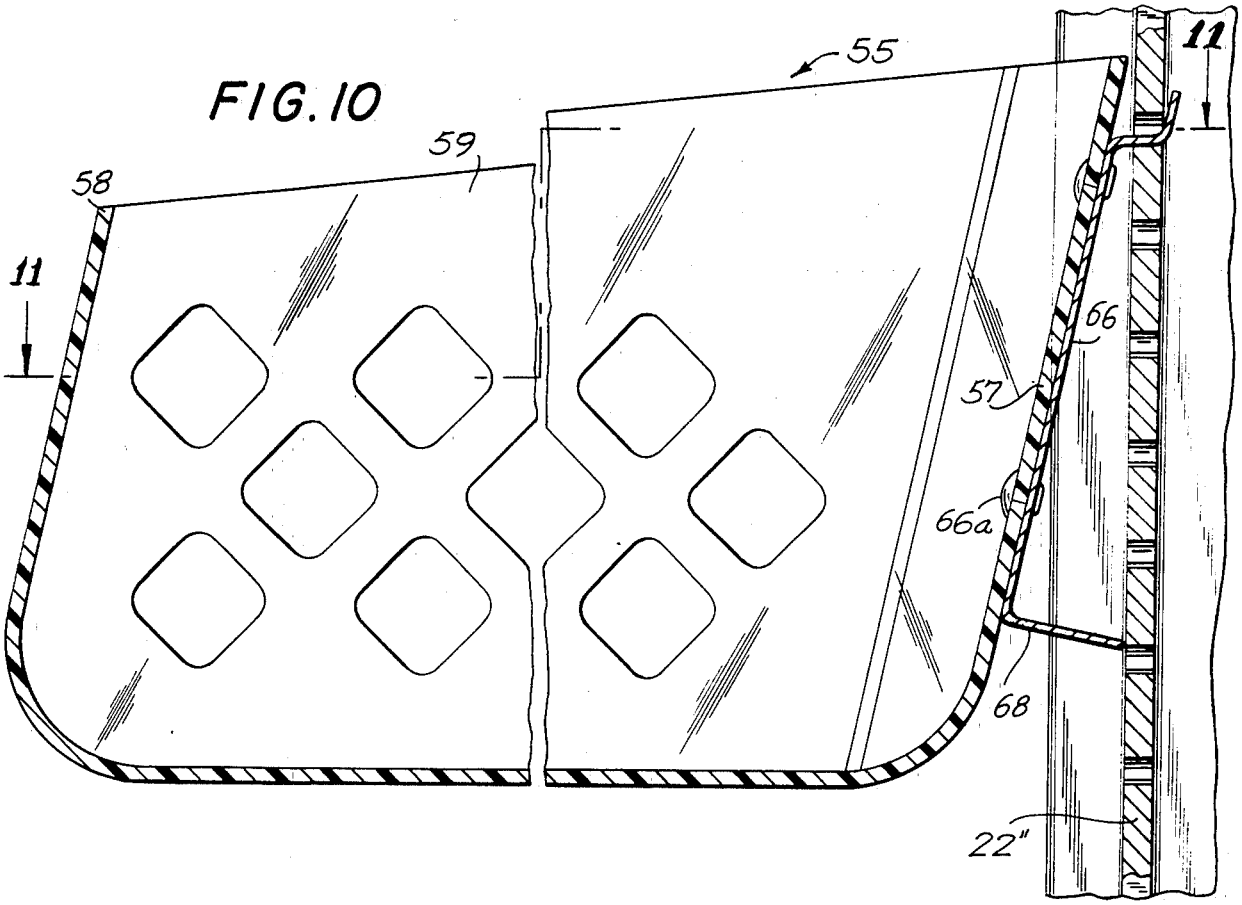
FIG. 10 is a fragmentary sectional view, similar to FIG. 5, of the intermediate member of FIG. 9 but shown in the mounted state.
Figure 11:
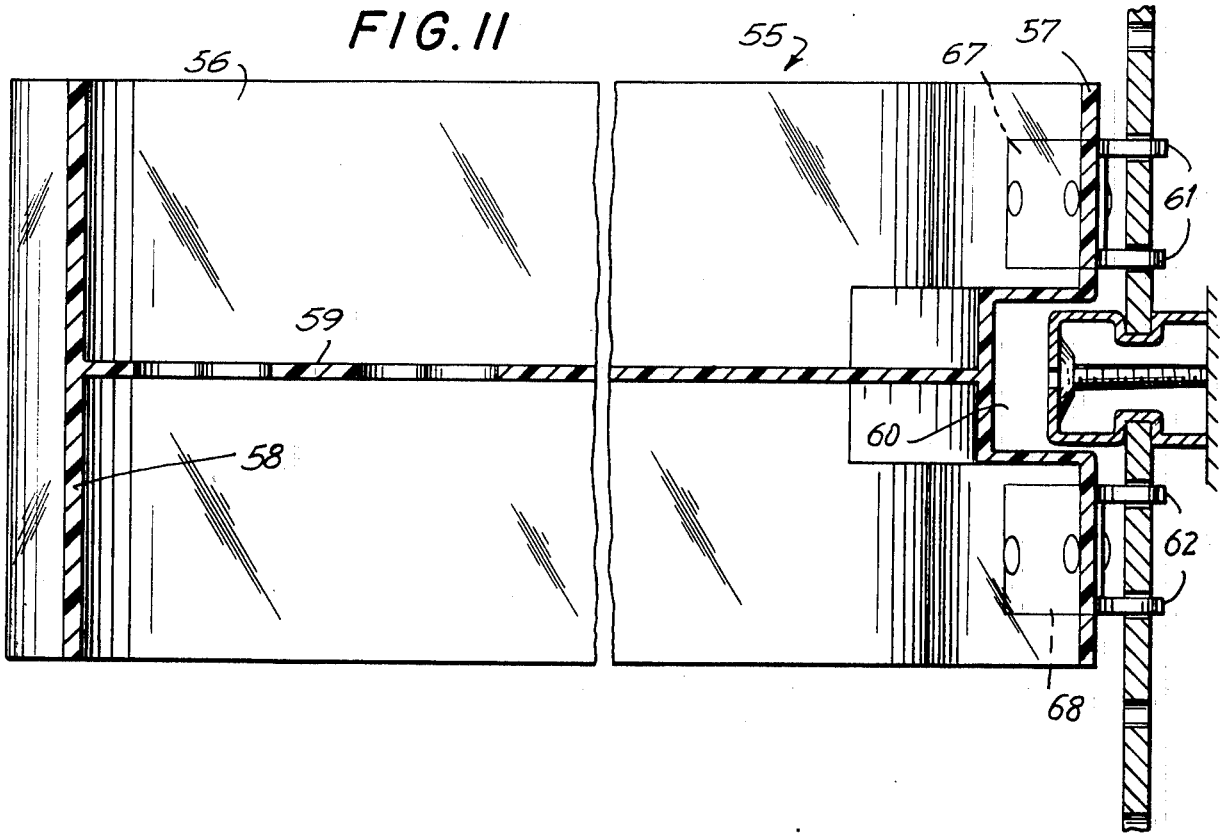
FIG. 11 is a sectional view taken along the line 11—11 in FIG. 10.

Referring now to FIGS. 9, 10 and 11, the intermediate fixture member 55 there shown is in its basic construction identical to the fixture member 45, and thus includes as corresponding elements a bottom wall 56, a rear end wall 57 oriented at an obtuse angle to the bottom wall, a front end wall 58 parallel to the rear end wall, a medial dividing wall 59, a post-accommodating step region 60 at the juncture between the rear end wall and the dividing wall, and respective pairs of laterally displaceable hook-shaped prongs 61 and 62 extending rearwardly and upwardly relative to the sections of the rear end wall from a pair slotted rivet-accommodating brackets 63 and 64. The intermediate fixture member 55, however, constitutes a part of a display unit where both it and the associated left-hand and right-hand fixture members are intended to provide a split article-supporting surface which is oriented horizontally rather than at a downward slant. Accordingly, the brackets 63 and 64 on the intermediate fixture member 55 are provided withe respective downward extensions 65 and 66 which may be integral therewith or formed of separate elements secured thereto and pivotally secured to the lower regions of the rear end wall sections by respective rivets 65*a* and 66*a*. The extensions 65 and 66 terminate in respective transverse abutment sections 67 and 68 extending rearwardly of the rear end wall 57, the lengths of the abutment sections being such that when the fixture member 55 is mounted on a carrier board (or on two as shown) the rear end wall 57 is sufficiently inclined away from the carrier board(s) to dispose the bottom wall 56 horizontal. It will be understood, of course, that although they are not shown, the left-hand and right-hand fixture members associated with the intermediate fixture member 55 are necessarily identically equipped with the same brackets, extensions and abutment sections.

It will be understood that the foregoing description of preferred embodiments of the present invention is for purposes of illustration only, and that the various structural and operational features herein disclosed are susceptible to a number of modifications and changes none of which entails any departure from the spirit and scope of the present invention as defined in the hereto appended claims.

What is claimed is:

1. A modular display unit for supporting articles of merchandise and adapted to be secured to an upright support structure, said display unit comprising:

(a) a pair of elongated, laterally grooved, posts adapted to be secured to the support structure in vertical orientation and at a horizontally spacing from one another with one groove of one post facing and aligned with one groove of the other post, (b) an apertured carrier board having a front surface and a back surface, said carrier board being adapted to be engaged by and extend between said posts, with each of the opposite side edges of said board being fitted into the proximate one of said grooves of the adjacent one of said posts, and to be secured thereby to said support structure with said front surface of said carrier board facing away from said support structure and with at least a portion of each of said vertical posts projecting frontwardly of said front surface of said carrier board; and (c) at least one pair of article-supporting fixture members adapted to be mounted on said carrier board, said fixture members each having a front end wall, a rear end wall, a bottom wall and a side wall extending along one side of said bottom wall between said front and rear end walls, (i) said side wall of one of said fixture members being located to the left of its associated bottom wall, and said side wall of the other of said fixture members being located to the right of its associated bottom wall, when said fixture members are viewed in the front to rear direction, (ii) a respective pair of generally hook-shaped prongs extending rearwardly from said rear end wall of each fixture member, said prongs being adapted to enter respective apertures in said carrier board for mounting said fixture members on said carrier board, and (iii) said side wall of each fixture member and its associated rear end wall being foreshortened at their juncture with each other to define over the entire height of the respective fixture member a step region, the depth of said step region of each fixture member frontwardly of said rear end wall of that fixture member being sufficient, when said prongs of that fixture member are received in a pair of said apertures adjacent and either to the left or to the right of a respective one of said posts depending on whether the side wall of that fixture member is located to the right or to the left of the associated bottom wall, to accommodate the portion of said respective one of said posts which projects frontwardly of said front surface of said carrier board when the latter is engaged by said respective one of said posts, (iv) said fixture members, when mounted on said carrier board and having their bottom walls substantially in transverse alignment with each other and having their side walls located at the sides of said bottom walls which are directed away from each other, cooperating to define an upwardly open compartment having a split article-supporting surface constituted by said bottom walls and having lateral boundary surfaces constituted by said side walls.

2. A display unit as claimed in claim 1, wherein said prongs of each fixture member are located in the upper region of the associated rear end wall, and each fixture member is further provided in the lower region of the associated rear end wall with a plurality of protuberances extending rearwardly from that rear end wall, said protuberances of each fixture being shaped, dimensioned and spaced from each other so as to be able to enter respective apertures in said carrier board when that fixture member is mounted thereon by means of the associated prongs.

3. A display unit as claimed in claim 2, wherein said protuberances on each of said fixture members are disposed at different levels above the respective bottom wall, with at least the protuberance that is closest to the associated side wall being at a lower level than at least one other protuberance on the same rear end wall.

4. A display unit as claimed in claim 1, wherein said prongs of each fixture member are displaceably secured to the associated rear end wall to enable their positions to be adjusted for accommodating the fixed locations of said apertures in said carrier board.

5. A display unit as claimed in claim 1, wherein said front end, rear end, bottom and side walls of each fixture member are generally planar, said bottom walls of said fixture members are oriented at identical obtuse angles to the associated rear end walls, said prongs of each fixture member are located in the upper region of the associated rear end wall, and each fixture member is further provided in the lower region of the associated rear end wall with a rearwardly extending abutment engageable with said carrier board, said abutments being dimensioned such that when said fixture members are mounted on said carrier board with said abutments engaging the latter, said bottom walls are disposed substantially horizontal.

6. A display unit as claimed in claim 1, further comprising at least one additional fixture member having a front end wall, a rear end wall, a bottom wall, and a dividing wall extending between said front and rear end walls of said additional fixture member and substantially midway between the opposite sides of the associated bottom wall, a respective pair of generally hook-shaped prongs extending rearwardly from each of the sections of said rear end wall of said additional fixture member disposed at the opposite sides of said dividing wall, and said rear end wall of said additional fixture member being provided at its juncture with said dividing wall with a frontward step region the depth of which frontwardly of that rear end wall and the width of which transversely of said dividing wall are sufficient to accommodate the portion of a respective post which projects frontwardly of said front surface of said carrier board, said additional fixture member, when mounted on said carrier board between said first-mentioned fixture members and with its bottom wall in transverse alignment with said bottom walls of said first-mentioned fixture members, cooperating with the latter to define a pair of upwardly open compartments separated from one another by said dividing wall and each having a split article-supporting surface bounded at the side remote from said dividing wall by the associated one of said side walls of said first-mentioned fixture members.

7. A display unit as claimed in claim 6, wherein said front end, rear end, bottom and side walls of each of said first-mentioned fixture members and said front end, rear end, bottom and dividing walls of said additional fixture member are generally planar, said bottom walls of said fixture members are oriented at identical obtuse angles to the associated rear end walls, said prongs of each fixture member are located in the upper region of the associated rear end wall, and each fixture member is further provided in the lower region of the associated rear end wall with a rearwardly extending abutment engageable with said carrier board, said abutments being dimensioned such that when said fixture members are mounted on said carrier board with said abutments engaging the latter, said bottom walls are disposed substantially horizontal.

8. A display unit as claimed in claim 6, wherein said prongs of each fixture member are displaceably secured to the associated rear end wall to enable their positions to be adjusted for accommodating the fixed locations of said apertures in said carrier board.

* * * * *